US005368665A

United States Patent [19]

Koyama et al.

[11] Patent Number: 5,368,665

[45] Date of Patent: Nov. 29, 1994

[54] METHOD OF JOINTING POROUS BUILDING PLATES

[75] Inventors: Akihisa Koyama; Syoji Kitahara; Tomonori Honda, all of Aichi, Japan

[73] Assignee: INAX Corporation, Tokoname, Japan

[21] Appl. No.: 983,711

[22] Filed: Dec. 1, 1992

[30] Foreign Application Priority Data

Dec. 5, 1991 [JP] Japan ..... 3-321863

[51] Int. Cl.[5] ..... B29C 71/00; B32B 31/12; E04B 1/16; E04F 13/00

[52] U.S. Cl. ..... 156/71; 52/389; 52/744; 52/747; 156/278; 156/280; 264/35; 264/133; 264/135; 264/233; 264/264; 264/344; 264/DIG. 31

[58] Field of Search ..... 264/DIG. 31, 35, 131, 264/133, 135, 233, 264, 265, 344; 156/71, 278–280; 52/744, 747, 746, 314, 315, 311.1, 389, 34, 35

[56] References Cited

U.S. PATENT DOCUMENTS

| | | | |
|---|---|---|---|
| 664,169 | 12/1900 | Mueller et al. | 52/746 |
| 3,208,190 | 9/1965 | Kakos et al. | 52/389 |
| 3,515,611 | 6/1970 | Muhlberg et al. . | |
| 3,735,545 | 5/1973 | Bernett | 52/744 |
| 3,854,267 | 12/1974 | Weiant et al. | 52/744 |

FOREIGN PATENT DOCUMENTS

| | | | |
|---|---|---|---|
| 0066002 | 12/1982 | European Pat. Off. . | |
| 1879213 | 9/1963 | Germany . | |
| 1659911 | 4/1970 | Germany . | |
| 2442505 | 3/1976 | Germany . | |
| 49-5894 | 2/1974 | Japan | 156/71 |
| 1242546 | 8/1971 | United Kingdom . | |

*Primary Examiner*—Karen Aftergut
*Attorney, Agent, or Firm*—Kanesaka & Takeuchi

[57] ABSTRACT

A method of applying porous building plates includes applying plate-like porous building plates having pores on the surfaces and then jointing them by means of a coated joint method. In the method, the pores on the surfaces of the porous building plates are packed with an acid soluble substance and then the plates are joined by means of a coated joint method. Subsequently, the surfaces of the porous building plates are washed with an acid.

4 Claims, No Drawings

METHOD OF JOINTING POROUS BUILDING PLATES

FIELD OF THE INVENTION

The present invention concerns a porous building plate and a method of jointing same and, more specifically, it relates to a method of applying porous building plates, for example, to walls, floors or plates and then jointing them by a coated joint method.

DESCRIPTION OF THE PRIOR ART

As a method of facing tiles, there has been a method of facing tiles, for example, to plates, walls or floors and then jointing them by means of a coated joint method. The coated joint method comprises coating a joint material in a slurry to the entire surfaces of tiles including joint spaces and then washing out to remove the joint material deposited to the surfaces of the tiles.

In a case of jointing tiles having pores on the surfaces by the coated joint method, the joint material is filled not only in the joint spaces but also in the pores on the surfaces of the tiles. The joint material filled in the pores on the surfaces of the tiles is difficult to be removed even by the subsequent water washing. Since tiles having pores on the surfaces filled with the joint material show different tone and feeling from those of usual tiles, they provide contaminated appearance for the surfaces of the applied tiles. A tile having pores on the surface provides a merit in that it is less slippy even when wetted with water since the surface is toughened by the pores. However, a tile having pores filled with the joint material is flattened at the surface to lose the above-mentioned merit.

OBJECT AND SUMMARY OF THE INVENTION

It is an object of the present invention to provide a porous building plate which is suitable for use in a coated joint method.

Another object of the present invention is to form a fine and less slippy surfaces for tiles applied.

In the method of applying porous building plates of facing plate-like porous building plates having pores on the surfaces and then jointing them by a coated joint method, the first aspect of the present invention comprises packing pores on the surfaces of the porous building plates with an acid soluble substance, applying facing, jointing them by a coated joint method and, subsequently, washing the surfaces of the porous building plates with an acid.

In the method of applying porous building plates of facing plate-like porous building plates having pores on the surfaces and then jointing them by a coated joint method, the second aspect of the present invention comprises facing the porous building plates, packing pores on the surfaces of porous building plates with an acid soluble substance, jointing them by a coated joint method and, subsequently, washing the surfaces of the porous building plates with an acid.

In plate-like porous building plates having pores on the surfaces, the third aspect of the present invention provides a porous building plate in which pores on the surface are packed with an acid soluble substance.

A preferred method of applying porous building plates according to the present invention includes the following two methods (A) and (B), (A):

(1) Filling pores on the surfaces of porous building plates with an acid soluble substance, (2) Facing the porous building plates applied with the packing treatment in the step (1) above to a building body.

(3) Jointing by a coated joint method, (4) Washing the surfaces of the porous building plates with water and washing out the joint material deposited to the surfaces of the porous building plates in the stem (3) above.

(5) Washing the surfaces of the porous building plate with an acid thereby dissolving to remove the acid soluble substance packed in the pores on the surfaces of the porous building plates.

(6) Washing the surfaces of the porous building plates with water again.

(B):

i) Applying the porous building plates to a building body.

ii) Filling the pores on the surfaces of the applied porous building plates with an acid soluble substance.

iii) Jointing them by a coated joint method.

iv) Washing the surfaces of the porous building plates with water thereby washing out the joint material deposited to the surfaces of the porous building plates in the step (iii) above.

v) Washing the surfaces of the porous building plates with an acid thereby dissolving to remove the acid soluble substance packed in the pores on the surfaces of the porous building plates.

vi) Washing the surfaces of the porous building plates with water again,

In particular, by the method (A) described above, since the porous building plates in which the pores on the surface are previously packed with the acid soluble substance are used, it is no longer necessary for pore packing treatment in the packed facing tiles.

In the present invention, as the acid soluble substance to be packed in the pores on the surface of the porous building plate, those which are less soluble or insoluble to water and easily soluble to an acid are preferred. For instance, there can be mentioned salts of weak acid and strong base such as calcium carbonate or calcium acetate. Among them, calcium carbonate is preferred since it is less expensive.

Upon packing the acid soluble substance in the pores, an aqueous slurry containing about 10 to 50% by weight of the acid soluble substance such as calcium carbonate is prepared and the slurry is coated and dried on the surface of the porous building plate. The acid soluble substance such as calcium carbonate in the slurry is packed in the pores on the surface of the porous building plate. Slurry joint material can not invade in the packed pores.

In the present invention, after facing the porous building plates, usual coated joint method is applied. That is, a slurry joint material is at first coated to the joint space on the surface of the building plate. As the joint material, any of commercially available materials can be used. Cement type joint materials which have often been used, can be employed also in the present invention.

After coating the joint material to the surfaces of the building plates and the joint spaces, the surfaces of the porous building plates are washed with water to wash out the joint material deposited to the surfaces of the porous building plates. Subsequently, the acid soluble substance in the pores on the surfaces of the porous building plates is removed by dissolution with an acid. As the acid, a diluted solution of about 1 to 10% by weight of hydrochloric acid is preferably used in view of the handlability and easy availability. After washing with the acid, they are washed again with water to remove excess acid, dissolved joint material and a solution containing fine particles.

For washing with water and acid, the surfaces of the porous building plates are wiped with a sponge impregnated with water or diluted hydrochloric acid, or water or diluted hydrochloric acid is sprayed to the surfaces of the porous building plates, for example, by spraying.

The building plates after removal of the packed material by washing with acid and water have substantially the same surfaces as those of "usual" building plates before they are packed with the material.

In the present invention, the porous building plate comprises a plate-like building plate such as a porous plate in which continuous pores or closed pores are exposed to the surface. The plate material may be porous throughout the entire portion or only at the surface layer.

PREFERRED EMBODIMENT

Description will now be made more specifically to the present invention with reference to examples.

EXAMPLE 1

Commercially available calcium carbonate (industrial powder) in the form of an aqueous 20 wt % slurry dispersion was coated to the surfaces of porous tiles (300 mm square) in which closed pores are opened at the surface, to pack calcium carbonate in the pores on the surfaces. The tiles were faced to a building block and applied with jointing with a cement type joint material by means of a coated joint method.

Subsequently, the joint material on the surfaces of the tiles were washed out by washing with water and then calcium carbonate in the pores on the surfaces of the tiles was washed with an aqueous 3 wt % of hydrochloric acid and removed by dissolution and then they were washed with water again.

For the resultant tiles applied, lightness L* and hues a*, b* were measured and a color difference $\Delta E^*_{ab}$ was determined from the difference for each of the values of the tiles before application in accordance with the following equation.

$$\begin{aligned}\Delta E^*_{ab} &= [(\Delta L^*)^2 + (\Delta a^*)^2 + (\Delta b^*)^2]^{\frac{1}{2}} \\ &= [(61.175 - 61.083)^2 + (-2.375 - (-2.388)^2 + \\ &\quad ((2.268) - 2.088)^2]^{\frac{1}{2}} \\ &= 0.20\end{aligned}$$

Further, for the tiles at the applied surfaces, slipping resistance coefficient (CSR.B) was measured upon wetting with water and wetting with liquid soap, which was compared with the tiles before application.

On the other hand, for the comparison, jointing was applied in the same manner excepting for not conducting the packing treatment and acid washing, and measurement was conducted in the same manner as for the tiles on the applied surface. Then, the color difference $\Delta E^*_{ab}$ was determined as follows and the slipping resistance coefficient was measured in the same manner.

$$\begin{aligned}\Delta E^*_{ab} &= [(\Delta L^*)^2 + (\Delta a^*)^2 + (\Delta b^*)^2]^{\frac{1}{2}} \\ &= [(62.268 - 54.618)^2 + (-3.61 + 2.978)^2 + \\ &\quad (6.92 - 4.298)^2]^{\frac{1}{2}} \\ &= 8.11.\end{aligned}$$

The results are collectively shown in Table 1.

TABLE 1

| | Tile | | | | | |
|---|---|---|---|---|---|---|
| | Color specification value | | | Color difference | Sliding resistance coefficient (CSR · B) | |
| Example | L* | a* | b* | $\Delta E^*_{ab}$ | Water | Liquid soap |
| Example | | | | | | |
| Before application | 61.175 | −2.375 | 2.268 | — | 1.42 | 0.921 |
| Application after packing | 61.083 | −2.388 | 2.088 | 0.20 | 1.41 | 0.902 |
| Comp. Example | | | | | | |
| Before application | 62.268 | −3.61 | +6.92 | — | 1.43 | 0.922 |
| Application after packing | 54.618 | −2.978 | +4.298 | 8.11 | 1.05 | 0.655 |

From the foregoing results, the followings are apparent. In the tiles at the applied surfaces by the existent method, since the surfaces of the tiles were filled in the pores with the joint material, the tone was remarkably changed as color difference of $\Delta E^*_{ab}=8.11$ from the tone of the tiles before application. On the other hand, the tone of the tile before the application according to the present invention shows no substantial change as: color difference $\Delta E^*_{ab}=0.20$ from the tone of the tiles before application.

Also referring to the slipping resistance coefficient, since the pores on the surface of the tile were filled with the joint material, the toughened surface due to the surface of the pores was lost and it became remarkably slippy in the existent method, whereas the slipping resistance coefficient showed no substantial change from that before application and toughened surface due to the surface of the pores was kept in the present invention.

What is claimed is:

1. A method of applying building plates which are porous at least at a surface thereof to a member comprising:

a first step of packing pores on the surface of each of the porous building plates with an acid soluble material formed of calcium carbonate, a second step of applying the porous building plates to the member, a third step of applying a coated joint material in a form of a slurry onto an entire area including the porous building plates having the acid soluble material formed of calcium carbonate packed in the pores and including joint spaces between the porous building plates so that the joint material is filled in the joint spaces and is coated onto the surface of each of the porous building plates, a fourth step of washing the surface of each of the porous building plates with water, thereby washing out the joint material coated on the surface of each of the porous building plates, a fifth step of washing the surface of each of the porous building plates with an acid, thereby dissolving the acid soluble material formed of calcium carbonate and packed in the pores of the porous building plate into the acid to remove the acid soluble material formed of calcium carbonate from the packed pores on the surface of each of the porous building plates, and a sixth step of washing the surface of each of the porous building plates with water again, wherein the porous building plates are applied to the member without invasion of the joint material into the pores on the surface of each of the porous building plates due to the packing of the pores with the acid soluble material formed of calcium carbonate.

2. A method as defined in claim 1, wherein the acid is hydrochloric acid.

3. A method of applying porous building plates which are porous at least at a surface thereof to a member comprising:

a first step of applying the porous building plates to the member, a second step of packing an acid soluble material formed of calcium carbonate into pores on the surface of each of the porous building plates, a third step of applying a coated joint material in form of a slurry onto an entire area including the porous building plates having the acid soluble material formed of calcium carbonate packed in the pores and including joint spaces between the porous building plates so that the joint material is filled in the joint spaces and is coated onto the surface of each of the porous building plates, a fourth step of washing the surface of each of the porous building plates with water, thereby washing out the joint material coated on the surface of each of the porous building plates, a fifth step of washing the surface of each of the porous building plates with an acid, thereby dissolving the acid soluble material formed of calcium carbonate and packed in the pores of the porous building plate into the acid to remove the acid soluble material formed of calcium carbonate from the packed pores on the surface of each of the porous building plates, and a sixth step of washing the surface of each of the porous building plates with water again, wherein the porous building plates are applied to the member without invasion of the joint material into the pores on the surface of each of the porous building plates due to the packing of the pores with the acid soluble material formed of calcium carbonate.

4. A method as defined in claim 3, wherein the acid is hydrochloric acid.

* * * * *